US005570080A

United States Patent [19]

Inoue et al.

[11] Patent Number: 5,570,080

[45] Date of Patent: Oct. 29, 1996

[54] THEFT PREVENTION TAB DEVICE HAVING ALARM MECHANISM HOUSED THEREIN

[75] Inventors: Toshio Inoue, 9-8, Maikozaka 4-chome, Tarumi-ku, Kobe-shi, Hyogo; Tadashi Asada, Hyogo, both of Japan

[73] Assignee: Toshio Inoue, Hyogo, Japan

[21] Appl. No.: 330,553

[22] Filed: Oct. 28, 1994

Related U.S. Application Data

[63] Continuation-in-part of Ser. No. 51,295, Apr. 23, 1993, abandoned.

[30] Foreign Application Priority Data

| | | | |
|---|---|---|---|
| Apr. 24, 1992 | [JP] | Japan | 4-106693 |
| Mar. 11, 1993 | [JP] | Japan | 5-050786 |
| May 24, 1994 | [JP] | Japan | 6-109668 |

[51] Int. Cl.[6] ..... G08B 13/14

[52] U.S. Cl. ..... 340/571; 340/568; 340/693

[58] Field of Search ..... 340/572, 571, 340/568, 693

[56] References Cited

U.S. PATENT DOCUMENTS

| | | | |
|---|---|---|---|
| 4,211,995 | 7/1980 | Smith | 340/571 |
| 4,639,713 | 1/1987 | Kitagawa et al. | 340/568 |
| 4,686,513 | 8/1987 | Farrar et al. | 340/571 |
| 4,698,620 | 10/1987 | Marshall | 340/568 |
| 4,746,909 | 5/1988 | Israel et al. | 340/568 |
| 4,878,045 | 10/1989 | Tanaka et al. | 340/571 |
| 4,881,672 | 11/1989 | Gustafson | 340/571 |
| 5,068,643 | 11/1991 | Yoshina | 340/571 |
| 5,072,213 | 12/1991 | Close | 340/572 |

*Primary Examiner*—Jeffery Hofsass
*Assistant Examiner*—Benjamin C. Lee
*Attorney, Agent, or Firm*—Wenderoth, Lind & Ponack

[57] ABSTRACT

A tag device for theft prevention includes a tag body, a fastener for fastening the tag body to a merchandise, a wire extending from the tag body for fastening the tag body to a fixed member, a detector for detecting that the tag body has been detached from the merchandise, and an alarm for giving off an alarm if the detector detects that the tag body has been detached from the merchandise.

10 Claims, 12 Drawing Sheets

THEFT PREVENTION TAB DEVICE HAVING ALARM MECHANISM HOUSED THEREIN

This application is a continuation-in-part application of the U.S. patent application No. 08/051,295, filed Apr. 23, 1993, now abandoned.

BACKGROUND OF THE INVENTION

This invention relates to a tag device used mainly to prevent the theft of an article.

As is well-known in the art, these type of tags are attached to articles for sale to prevent them from being taken out of a shop bypassing the cashier. For this purpose, such a tag is provided with an alarm which is adapted to go off if it passes into a detection area installed at the exit of a store. The alarm will also sound if the tag is removed from the article by an unauthorized person.

The alarm function has to be neutralized when necessary, e.g. when changing tags or removing tags to pack the articles. Thus, such tags are provided with an alarm neutralizing mechanism.

A conventional alarm neutralizing mechanism has an extremely simple structure. Namely, merely by inserting a rod-shaped key into a slot formed in the tag, the alarm function is neutralized. Such a key is extremely simple in shape and can be copied easily. Also, a single key is used for many tags. Thus, if such a key should be copied by an unauthorized person, he or she can easily steal goods by using the copied key.

Possible solutions to this problem would be to prepare keys having more complicated shapes or to increase the kinds of keys used. But these solutions would make the handling of the article more difficult because the alarm function cannot be readily neutralized when necessary.

Another problem with a conventional tag is that the corresponding key has to be inserted in the hole in the tag not only to neutralize the alarm function e.g. when removing it from an article for packing, but also to activate it again after attaching the tag to article. Thus, the handling of tags is even more troublesome.

On the other hand, in the detection area at the exit of the store, such a tag is detected making use of electromagnetic waves. Thus, one can easily smuggle merchandise out of the store by covering the tag with a magnetic material.

Also, this detection system often malfunctions and gives off false alarms by reacting to customers' personal belongings instead of tags. Thus, many store owners are reluctant to use such tag detection system, for fear of possible trouble with customers.

An object of this invention is to provide a tag device which can securely detect the theft of an article while overcoming the drawbacks of conventional techniques.

SUMMARY OF THE INVENTION

A tag device according to the present invention comprises a tag body; a fastener means for fastening the tag body to a merchandise; a wire extending from the tag body for fastening the tag body to a fixed member; a detecting means for detecting that the tag body has been detached from the merchandise; and an alarm means for giving off an alarm if the detecting means detects that the tag body has been detached from the merchandise.

This tag device is fastened to the merchandise by the fastener means and to a fixed member through the wire. Thus, it is impossible to smuggle the merchandise out of the store. If the tag body is pulled apart from the merchandise, this fact is detected by the detecting means and the alarm means goes off.

The fastener means may be an adhesive tape or pressure-sensitive tape stuck on the bottom or side of the tag body.

The detecting means may be a limit switch which is turned on or off by coming into contact with the merchandise when the tag body is fastened to and pulled apart from the merchandise.

Also, the detector means may be a light switch housed in the tag body so that light directed to the light switch is interrupted by the merchandise when the tag body is fastened to the merchandise and reaches the light switch if the tag body is pulled apart from the merchandise.

The tag device may further comprises a second detector means for detecting that the wire has been cut. In this arrangement, the alarm means goes off if the second detector means detects that the wire has been cut.

The anti-theft tag device according to the present invention is fastened to merchandise by the fastener means and to a fixed member by the wire. Thus, no one can smuggle the merchandise out of the store. If the tag body is forcibly pulled apart from the merchandise, this fact is detected by the first detecting means and alarms are given. If the wire is cut, this fact is detected by the second detecting means and the alarm means goes off.

Thus, this tag device can be used as a highly reliable anti-theft device. Also, since the abovementioned first and second detecting means are least likely to malfunction, it is possible to minimize the possibility of trouble with customers.

Other features and objects of the present invention will become apparent from the following description made with reference to the accompanying drawings, in which:

DETAILED DESCRIPTION OF THE PREFERRED EMBODIMENT

Figure 1:
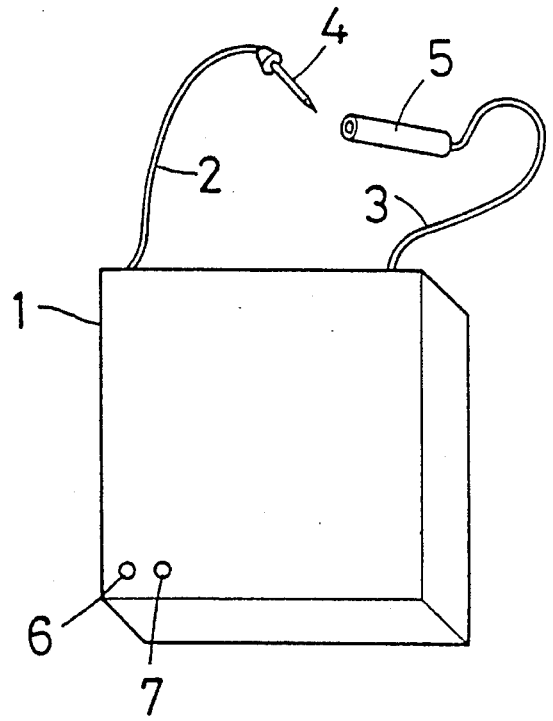
FIG. 1 is a perspective view showing the tag of a first embodiment of the detector according to this invention.
Figure 2:
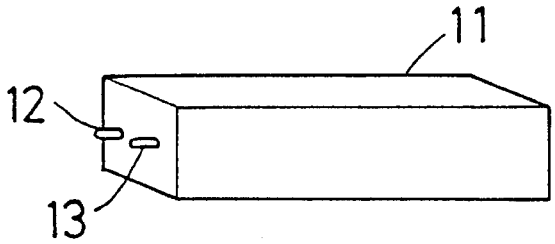
FIG. 2 is a perspective view of the code signal output unit of this embodiment.
Figure 3:
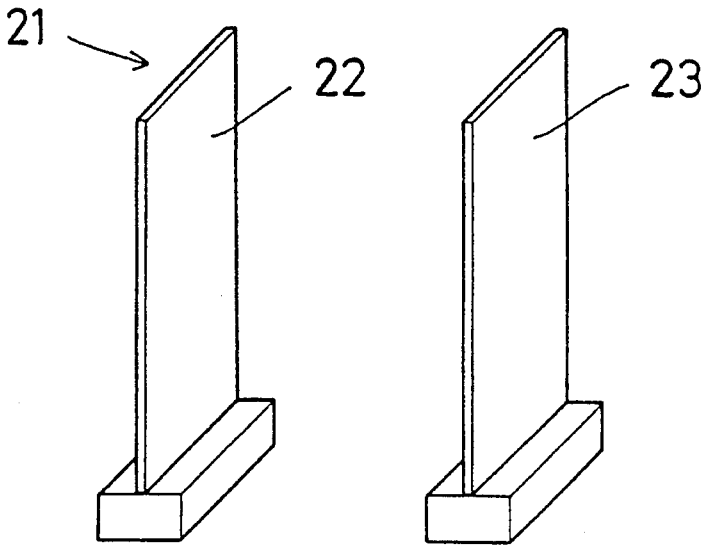
FIG. 3 is a perspective view of the radio wave transmission unit of this embodiment.

FIGS. 1–3 are perspective views showing the first embodiment of the detector according to this invention. FIG. 1 shows a tag of this embodiment. FIG. 2 shows a code signal output unit of this embodiment. FIG. 3 shows a radio wave transmission unit of this embodiment.

The tag 1 shown in FIG. 1 has a pair of leads 2 and 3. To one of the leads 2 is connected a pin 4. To the other lead 3 is connected a socket 5. These leads 2 and 3 are connected together by inserting the pin 4 in the socket 5. By doing so through part of an article (such as a button hole of a garment), the tag 1 can be attached to the article. A pair of flat terminals 6, 7 are provided on one side of the tag 1. These flat terminals 6, 7 are used to input code signals. Also, this tag 1 has a built-in antenna (shown in FIG. 5 and described below). When the tag 1 is in a detection area, the antenna receives radio waves that exist in the detection area.

A code signal output unit 11 shown in FIG. 2 has a pair of rod terminals 12, 13 protruding therefrom. A predetermined code signal is applied between the rod terminals 12 and 13. By pressing the rod terminals 12, 13 against the flat terminals 6 and 7 of the tag 1, the code signal is also applied between the flat terminals 6 and 7.

A radio wave transmission unit 21 shown in FIG. 3 comprises a radio wave transmission panel 22 and a dummy panel 23. The radio wave transmission panel 22 is for transmitting radio waves having a predetermined frequency. The dummy panel 23 is used for ornamental purposes. These two panels are provided on both sides of the doorway of a store. In this case, the radio waves transmitted from the radio wave transmission panel 22 pass through the doorway. Thus, the doorway serves as the detection area for the tag 1. If the tag is moved into the doorway, the radio waves of a predetermined frequency is caught by the abovementioned antenna in the tag 1. The detection area may be set up by providing only the radio wave transmission panel 22 with the dummy panel 23 omitted.

Figure 4:
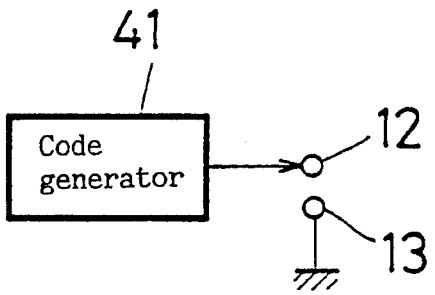
FIG. 4 is a block diagram showing the structure of the code signal output unit shown in FIG. 2.

FIG. 4 shows the structure of the code signal output unit 11. It has the rod terminals 12, 13 and a code signal generator 41 for generating a predetermined code signal and applying it between the rod terminals 12 and 13.

Figure 5:
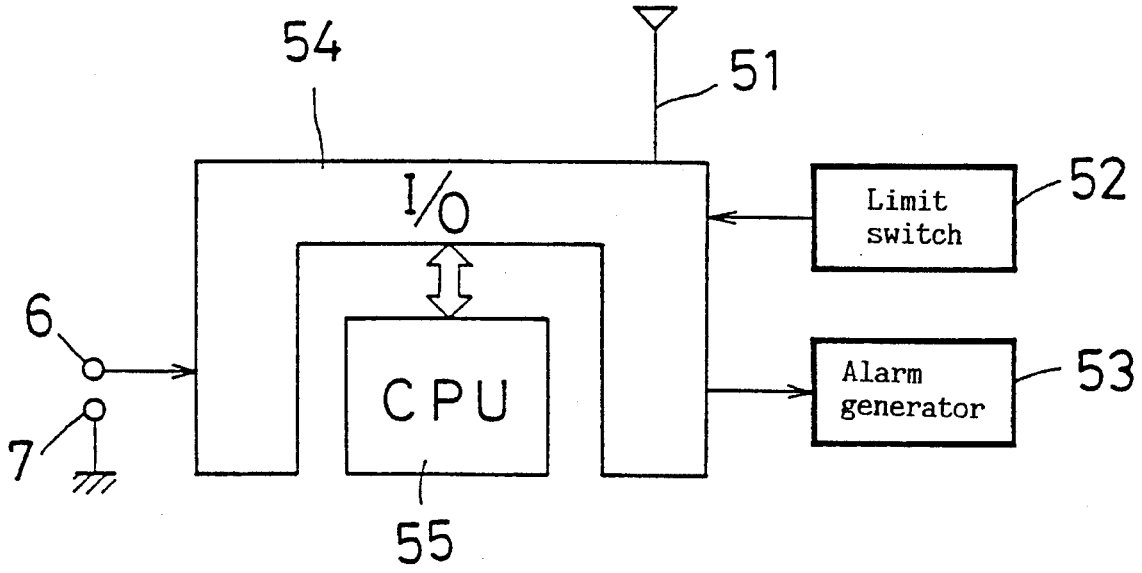
FIG. 5 is a block diagram showing the structure of the tag shown in FIG. 1.

FIG. 5 shows the structure of the tag 1. It has the flat terminals 6, 7, an antenna 51, a limit switch 52, an alarming sound generator 53, an input/output port 54 and a central processing unit (hereinafter referred to as CPU) 55.

The limit switch 52 corresponds to the leads 2 and 3 shown in FIG. 1. By inserting the pin 4 into the socket 5, it is turned ON. By disconnecting the pin from the socket 5, it is turned OFF.

CPU 55 controls the tag 1 by inputting the signals from the flat terminals 6, 7, antenna 51 and limit switch 52 through the input/output port 54 or by outputting signals to alarming generator 53 through the input/output port 54.

Figure 6:
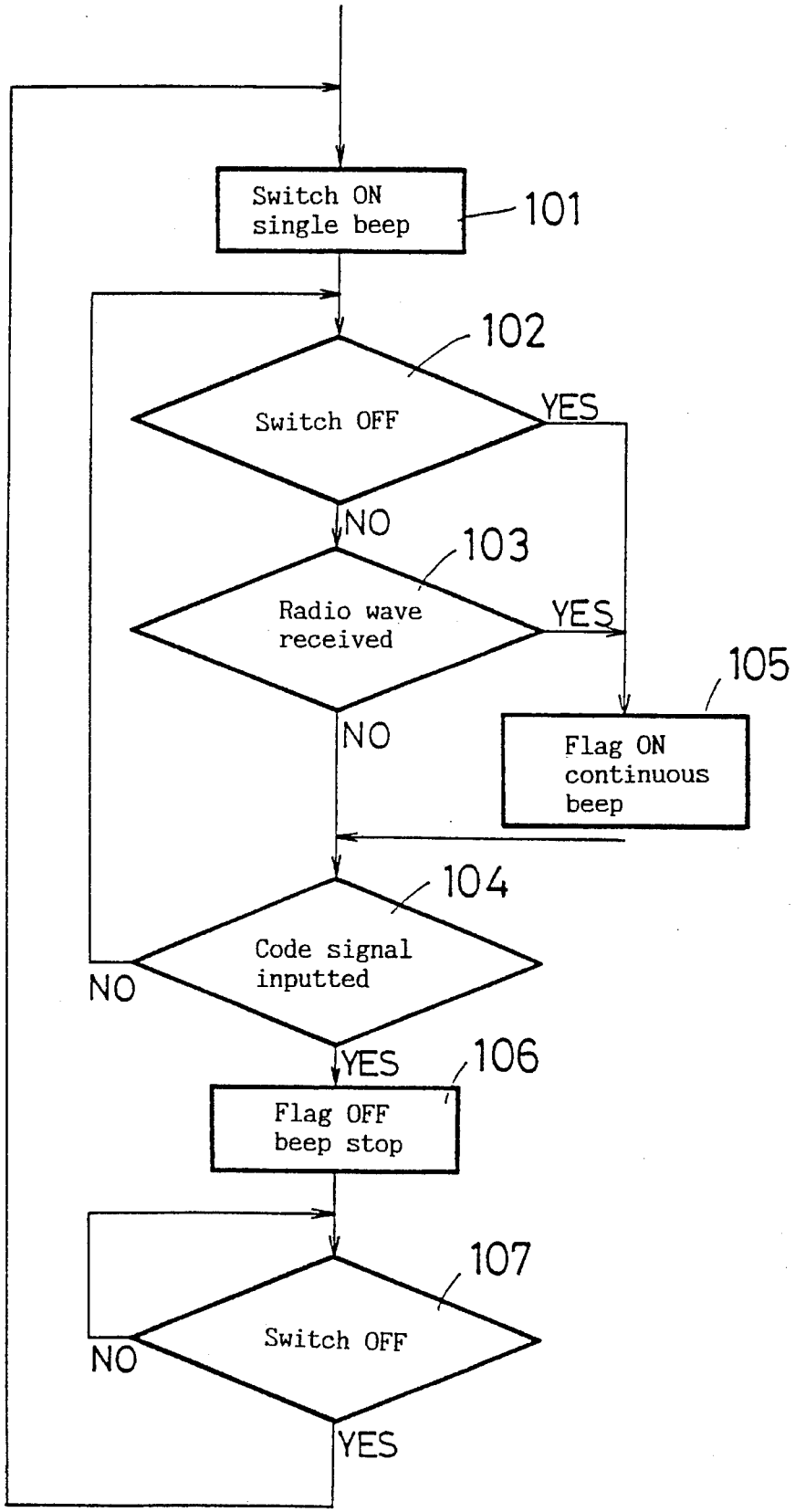
FIG. 6 is a flow chart showing the operation process carried out in the tag shown in FIG. 1.

Now we shall describe the process carried out in the tag 1 with reference to the flow chart shown in FIG. 6.

The socket 5 is inserted in the pin 4 of the tag 1 through part of an article to connect the leads 2 and 3 together and thus to turn the limit switch 52 ON. In response, the CPU 55 will control the alarming sound generator 53 to cause it to produce a single short alarming sound such as a "beep" sound (Step 101). The "beep" sound tells the user that the tag 1 is now set.

The CPU 55 then determines whether or not the limit switch 52 has been turned OFF (Step 102), whether or not radio waves have been received (Step 103), and whether or not code signals have been inputted (Step 104). If the limit switch 52 has not been turned OFF (Step 102, NO), if no radio waves have been received (Step 103, NO), and if no code signals are inputted (Step 104, NO), the CPU will repeat the above determination procedures.

If an unauthorized person attempts to disconnect the pin 4 from the socket 5 and remove the tag 1 from the article, the limit switch 52 will be turned OFF, which is detected by the CPU (Step 102, YES). The CPU thus turns a flag ON, which causes the alarming sound generator 53 to produce a continuous high-pitched "beep" alarming sound (Step 105). As long as the flag is turned ON, the alarming sound generator 53 keeps on producing the alarming sound.

In this state, if the rod terminals 12, 13 of the code signal output unit 11 are pressed against the flat terminals 6, 7 of the tag 1, the CPU 55 inputs the code signal from the code signal output unit 11 (Step 104, YES) and turns the flag OFF. The alarming sound from the alarming sound generator 53 thus stops (Step 106).

After confirming that the limit switch 52 remains OFF (Step 107, YES), the process in the CPU 55 returns to Step 101.

Thus, if the tag 1 should be removed from the article by an unauthorized person, an alarming sound is produced continuously and such an alarming sound cannot be stopped until the code signals are inputted into the tag 1 from the code signal output unit 11.

While if the limit switch 52 has not been turned OFF (Step 102, NO), no radio waves have been received (Step 103, NO), and no code signals have been inputted (Step 104, NO), if someone attempts to take the article with the tag out of the store through the doorway, i.e. the detection area, radio waves will be received by the antenna 51 and the CPU 55 will determine that radio waves have been received (Step 103, YES). Thus, the flag is turned ON and an alarming sound is produced continuously by the alarming sound generator 53 (Step 105).

In this state, by inputting the code signals from the code signal output unit 11 (Step 104, YES), the CPU 55 will turn the flag OFF to stop the alarming sound produced by the alarming sound generator 53 (Step 106). After the limit switch 52 has been turned OFF (Step 107, YES), the process in the CPU 55 will return to Step 101.

Thus, if someone attempts to take the article with the tag out of a store through the detection area, an alarming sound will be produced continuously, which cannot be stopped unless code signals are inputted from the code signal output unit 11 to the tag 1.

When the article with the tag 1 is handed over to a store clerk while the steps are repeated with the limit switch 52 not turned OFF (Step 102, NO), no radio waves received (Step 103, NO), and no code signals inputted (Step 104, NO), the clerk will press the rod terminals 12, 13 against the flat terminals 6, 7 of the tag 1 to neutralize the alarm function. Namely, the CPU 55 inputs the code signals from the code signal output unit 11 (Step 104, YES) and confirms that the flag is OFF (Step 106).

In this case, the setting of the flag has been OFF from the beginning because the flag has not been turned ON.

In this state, even when the clerk disconnects the pin 4 from the socket 5 to remove the tag 1 from the article, no alarming sound will be produced. After confirming that the limit switch 52 has been turned OFF (Step 107, YES), the CPU 55 will return to Step 101.

Thus, when code signals are inputted into the tag 1 attached to the article from the code signal output unit 11, no alarming sound is produced.

Thus, simply by pressing the rod terminals 12, 13 of the code signal output unit 11 against the flat terminals 6, 7 of the tag 1 to input code signals into the tag 1, the alarming function of the tag 1 can be neutralized. After neutralizing the alarm function, simply by turning the limit switch 52 OFF and then ON, the alarm function can be activated again. Such operations are very easy.

It is not an easy job to copy the code signal output unit 11 from the code signals produced by it. Thus, this device is highly effective as an antitheft means.

In the above embodiment, code signals are predetermined signals. But such signals may be set by code signal setting means provided in the tag 1 and the code signal output unit 11. In this case, since each store can set its own code signals, the possibility of theft can be reduced still further. The alarm is not limited to an alarming sound. It may be a light or a combination of a light and a sound.

Next, we will describe the second embodiment of the detector according to this invention.

Figure 7:
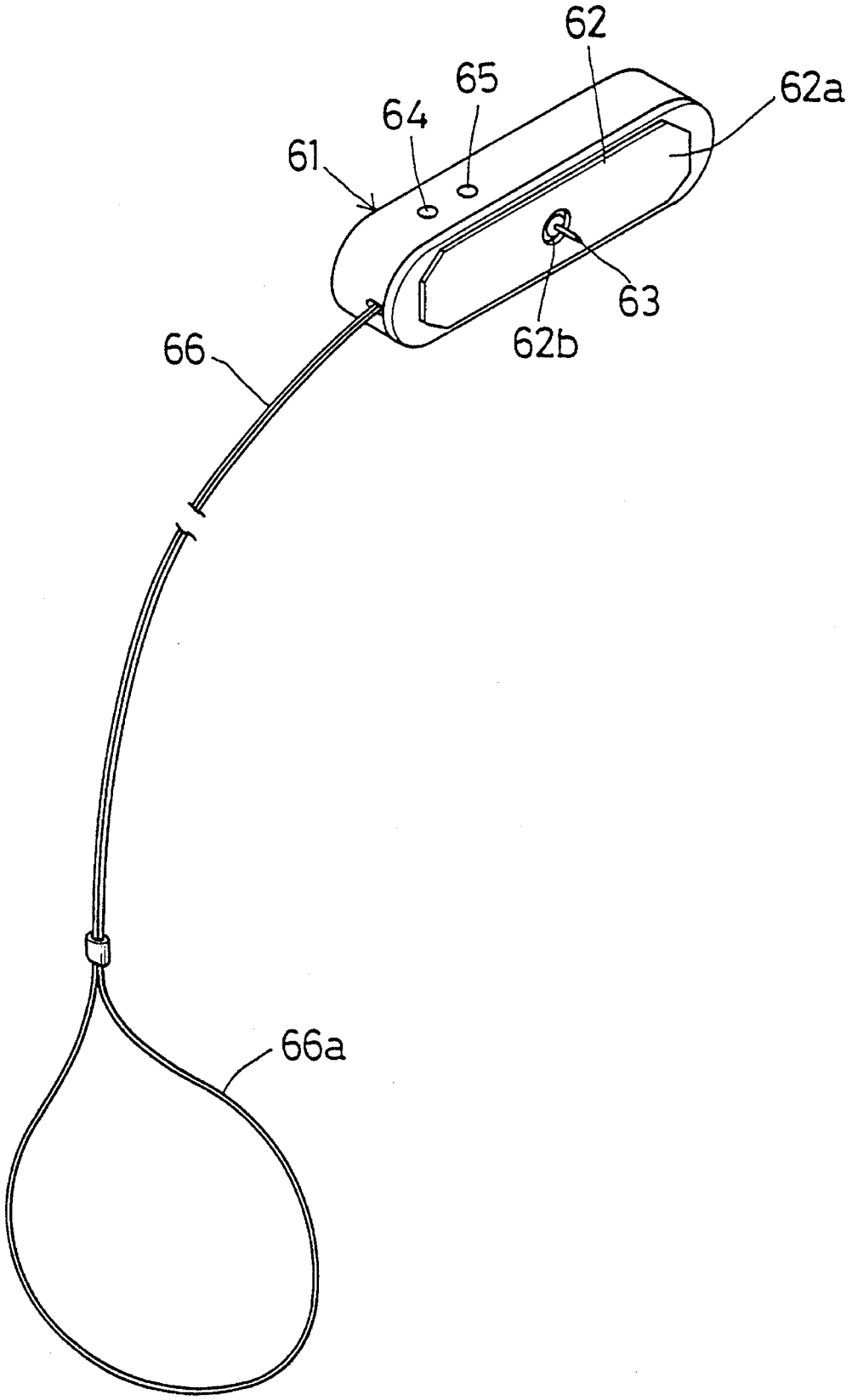
FIG. 7 is a perspective view showing the tag of a second embodiment of the detector.

FIG. 7 shows the tag of the second embodiment. A tag 61 of this embodiment is in the shape of a square pole and has an adhesive tape 62 stuck on its bottom. Its adhesive face is covered with release paper 62*a*. A limit switch 63 protrudes from the center of the bottom of the tag 61 through a hole 62*b* formed in the adhesive tape 62. A pair of flat terminals 64, 65 are provided on the side wall of the tag 61. A wire 66 extends from the tag.

Figure 8:
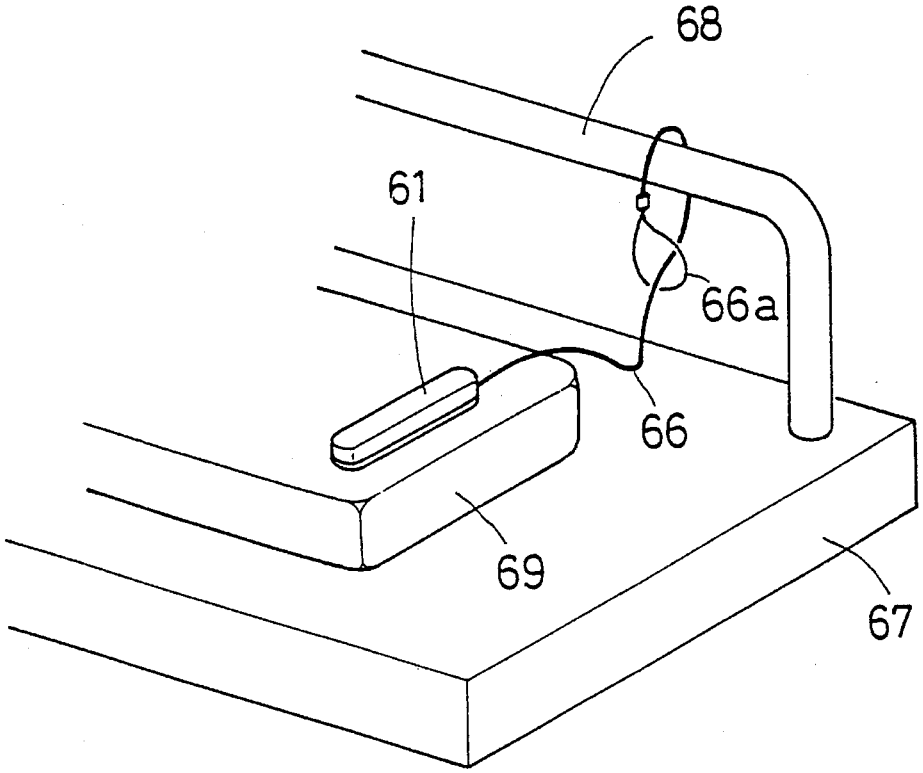
FIG. 8 is a perspective view of the tag shown in FIG. 8 showing how it is used.

In using the tag 61, as shown in FIG. 8, the wire 66 is wound around a shelf 67 for placing article and pass the tag 61 through a loop 66*a* of the wire 66 to tie the wire 66 around a frame 68 of the shelf 67. After peeling the release paper 62*a* from the adhesive tape 62 stuck on the bottom of the tag 61, the tag 61 is pressed against and fixed to an article 69 placed on the shelf 67. At this time, the limit switch 63 of the tag 61 is pushed up. In order to move the article 69 off the shelf 67 in this state, one has to either remove the tag 61 from the article 69 or cut the wire 66.

Figure 9:
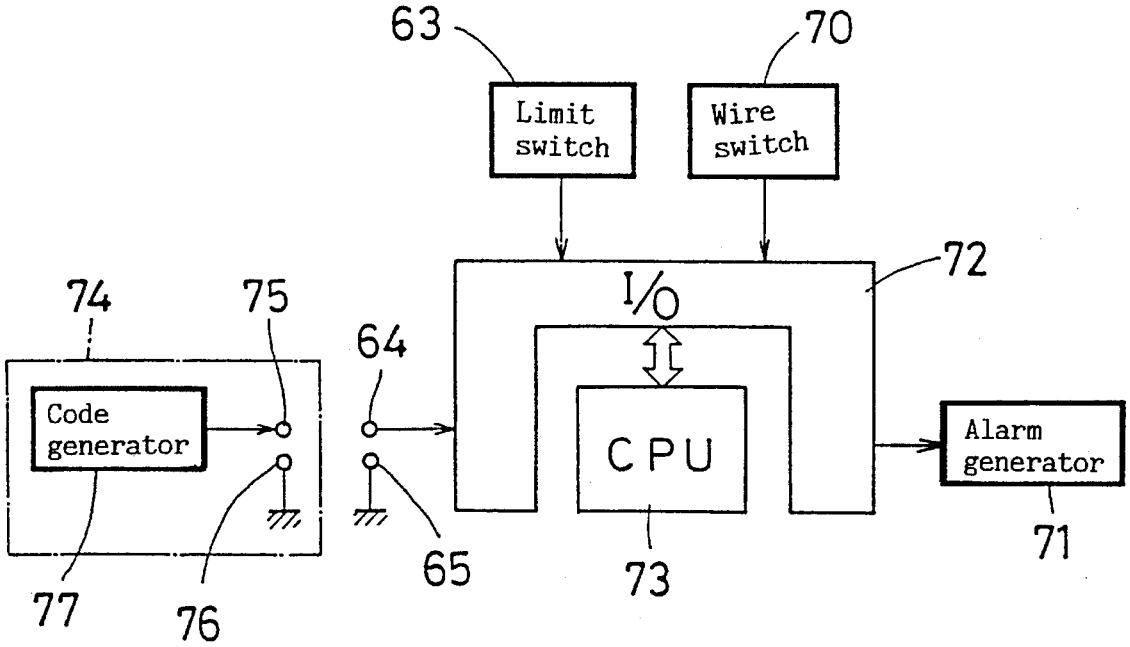
FIG. 9 is a block diagram showing the structure of the tag shown in FIG. 8.

FIG. 9 shows the structure of the tag 61. It has the flat terminals 64 and 65, the limit switch 63, a wire switch 70, an alarming sound generator 71, an input/output port 72, and a central processing unit (CPU) 73. The limit switch 63 is pushed up and turned ON when the tag 61 is attached to an article, and is turned OFF when the tag is removed. The wire switch 70 is normally kept ON. If the wire 66 is cut, it is turned OFF.

On the other hand, a code signal output unit 74 is a member separate from the tag 61 and, similar to the device shown in FIG. 4, it has a pair of rod terminals 75, 76 and a code signal generator 77.

Figure 10:
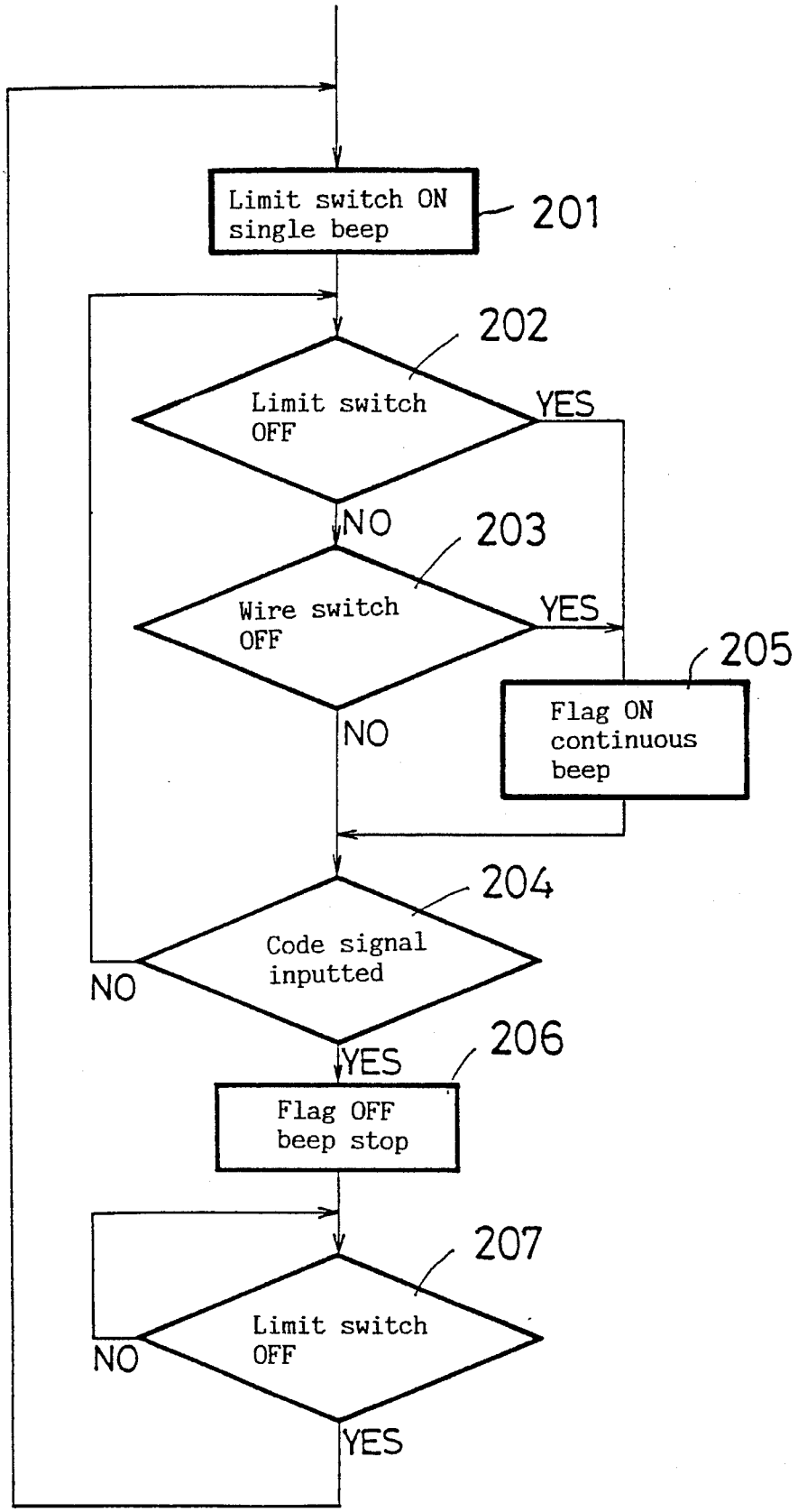
FIG. 10 is a flow chart showing the operation process carried out in the tag shown in FIG. 8.

We shall describe the operation carried out in the tag 61 with reference to the flow chart shown in FIG. 10.

When the tag 61 is attached to the article 69 as shown in FIG. 8 and the limit switch 63 is turned ON, the CPU 73 will cause the alarming sound generator 71 to produce a single short "beep" sound to tell the user that the tag 61 is now set (Step 201).

The CPU then determines whether or not the limit switch 63 has been turned OFF (Step 202), whether or not the wire switch 70 has been turned OFF (Step 203), and whether or not code signals have been inputted (Step 204). If the determination in every step is NO, the CPU will repeat the above determination steps.

If an unauthorized person attempts to remove the tag 61 from the article 69, the limit switch 63 will be turned OFF, which is detected by the CPU (Step 202, YES). The CPU will turn a flag ON. Similarly, if the wire 66 should be cut off, the CPU 73 determines that wire switch 70 has been turned OFF (Step 203, YES), thus setting the flag ON. Once the flag is turned ON, the CPU 73 will cause the alarming sound generator 71 to produce an alarming "beep" sound continuously (Step 205).

In this state, by pressing the rod terminals 75, 76 of the code signal output unit 74 against the flat terminals 64, 65 of the tag 61, the CPU 73 inputs the code signal from the code signal generator 77 (Step 204, YES) and turns the flag OFF. The alarming sound from the alarming sound generator 53 will stop (Step 206). After confirming that the limit switch 63 remains OFF (Step 207, YES), the CPU 55 will return to Step 201.

Thus, if the tag 61 should be removed from the article or the wire is cut by an unauthorized person, an alarming sound is produced continuously and such an alarming sound cannot be stopped until the code signals are inputted in the tag 61 from the code signal output unit 74.

In order to neutralize the alarming function while the processes in Steps 202, 203 and 204 are being executed, the rod terminals 75, 76 of the code signal output unit 74 are pressed against the flat terminals 64, 65 of the tag 61. In this case, the CPU 73 inputs code signals from the code signal generator 77 (Step 204, YES), confirms that the flag remains OFF (Step 206), and holds until the limit switch 63 is temporarily turned OFF in Step 207.

Namely, by inputting the code signals from the code signal output unit 74 to the tag 61, no alarming sound will be produced when removing the tag 61 from the article 69. Simply by attaching the tag to an article, the alarming function is activated again.

In the above embodiments, the code signals to be inputted in the tag from the code signal output unit were electric signals but they may be light signals.

Figure 11:
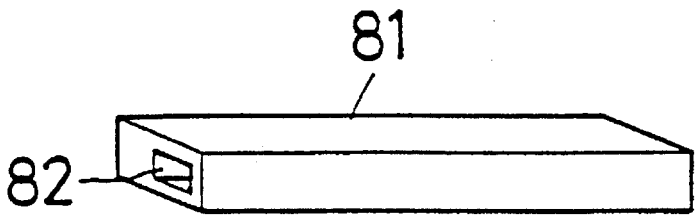
FIG. 11 is a perspective view of another example of the tag.

FIG. 11 shows a tag 81 having a built-in light receptor element for receiving light signals. The light receptor element (not shown) is mounted in the deep end of a hole 82. The tag 81 carries on its bottom a limit switch similar to that of the tag shown in FIG. 7.

Figure 12:
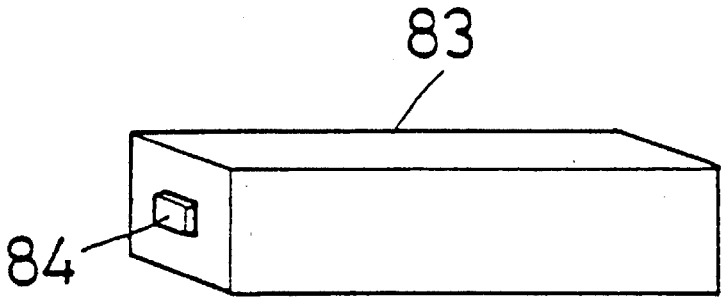
FIG. 12 is a perspective view of another example of the code signal output unit.

FIG. 12 shows a code signal output unit 83 for emitting light signals to the tag 81 shown in FIG. 11. It carries a light emitting element 84 for emitting light signals. By pressing the light emitting element 84 of the code signal output unit 83 in the hole 82 of the tag 81, light signals are inputted from the code signal output unit 83 to the tag 81. The alarming function is thus neutralized.

Figure 13:
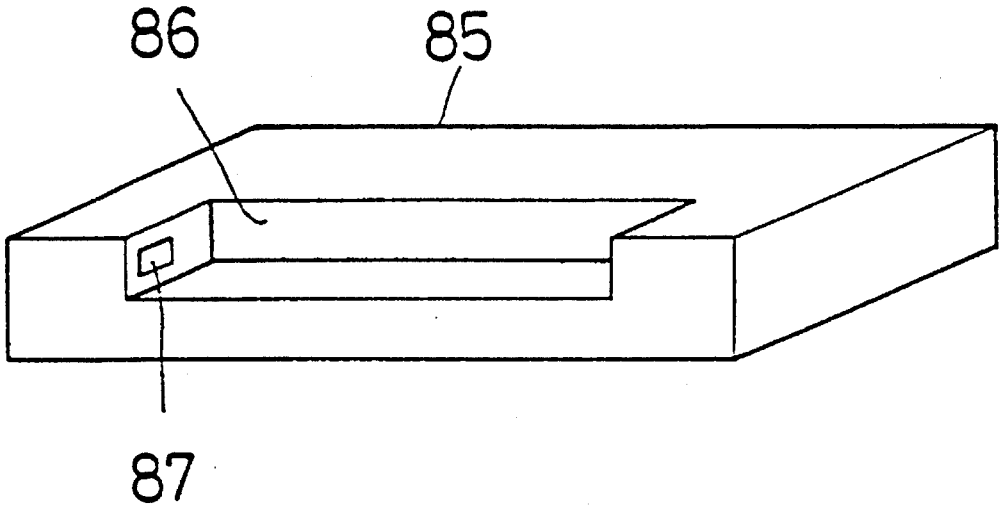
FIG. 13 is a perspective view of a further example of the code signal output unit.

FIG. 13 shows another example of the code signal output unit for emitting light signals. A code signal output unit 85 is a fixed type and is fixedly mounted to e.g. a cash register in a store. The code signal output unit 85 has a recess 86 for receiving the tag 81 shown in FIG. 11. A light emitting element 87 for emitting light signals is provided on the lefthand wall of the recess 86. By setting the tag 81 in the recess 86, the light receptor element of the tag 81 will face the light emitting element 87 of the code signal output unit 85, so that light signals are inputted in the tag 81 from the code signal output unit 85. The alarming function is thus neutralized.

The code signals to be outputted from the code signal output unit may be radio wave signals. In such a case, it is necessary to provide the code signal output unit with a modulator for inputting code signals and an antenna for transmitting the output of the modulator. On the other hand, the tag is complete with an antenna for receiving radio waves and a demodulator for demodulating the signals received by the antenna and outputting code signals.

The code signal output unit may be a movable type as the unit 83 shown in FIG. 12 or a fixed type as the unit 85 shown in FIG. 13. In case of a movable unit, radio wave signals are transmitted when the button is pressed. With a fixed type unit, radio wave signals are preferably transmitted within a predetermined range so that the tag can receive the signals when it is moved into this range. The range may be determined by adjusting the transmitting power of the radio wave signals or such a range may be defined by electromagnetic wave shield means.

On the other hand, if the tag receives radio wave signals directed to another tag, it might malfunction. In order to prevent this, the tag may be so adapted as to respond only to signals having an input level greater than a predetermined threshold.

Figure 14:
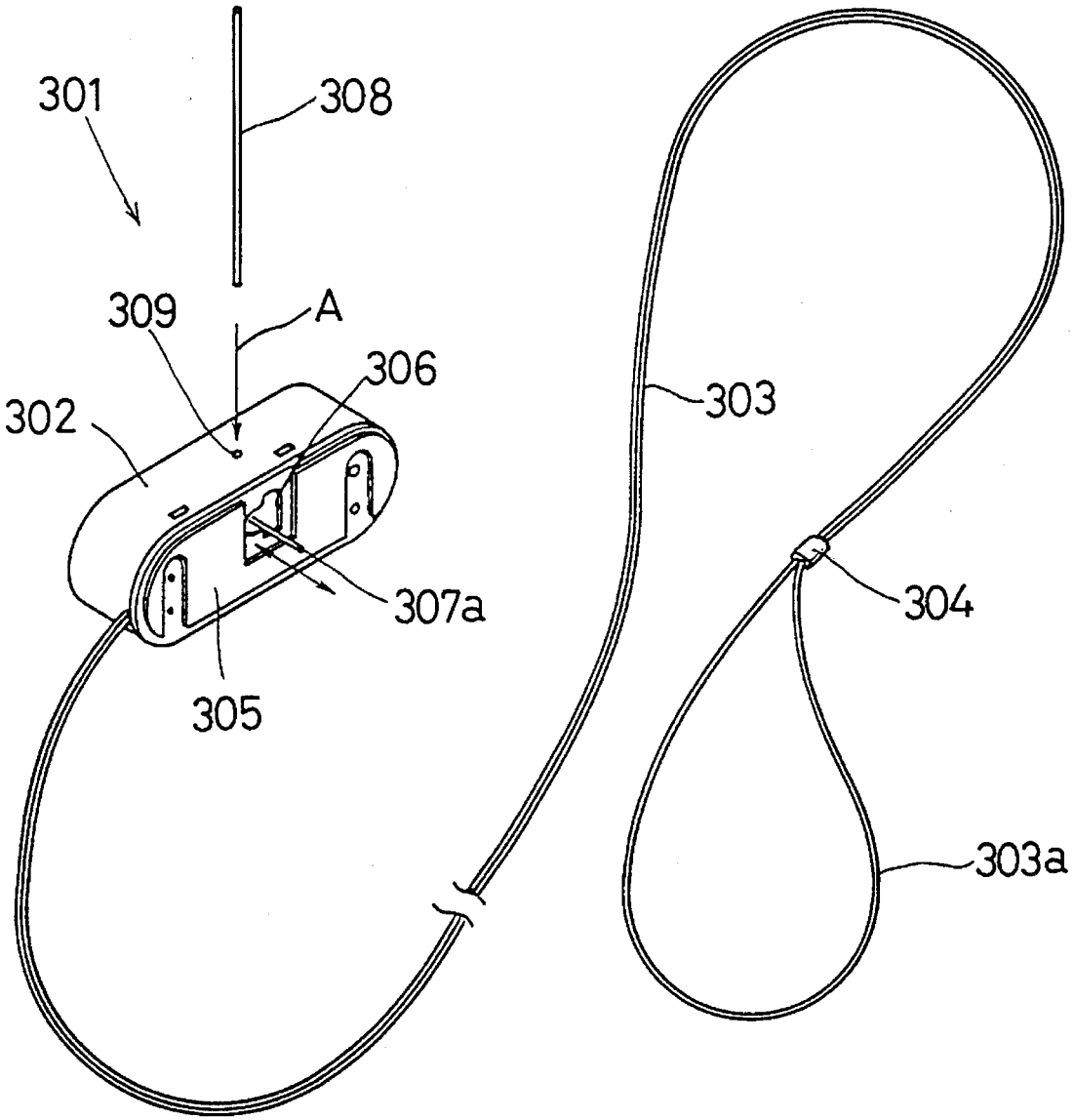
FIG. 14 is a perspective view of the tag device according to the present invention.

FIG. 14 shows another embodiment of the tag device according to this invention. The tag device 301 of this invention comprises a case 302 and a wire 303 extending from the case 303. The wire 302 is folded in two with both ends thereof connected to the case 302. The wire 303 has a loop portion 303*a* formed by clipping the wire together at its intermediate portion.

The case 302 is substantially box-shaped. A double-coated adhesive tape is stuck on its bottom. Also, a T-shaped hole 306 is formed in the bottom of the case 302 through which a plunger 307*a* of a limit switch 307 protrudes. Further, a small hole 309 is formed in one side of the case 302 through which a small-diameter rod 308 is adapted to be pushed in.

Figure 15:
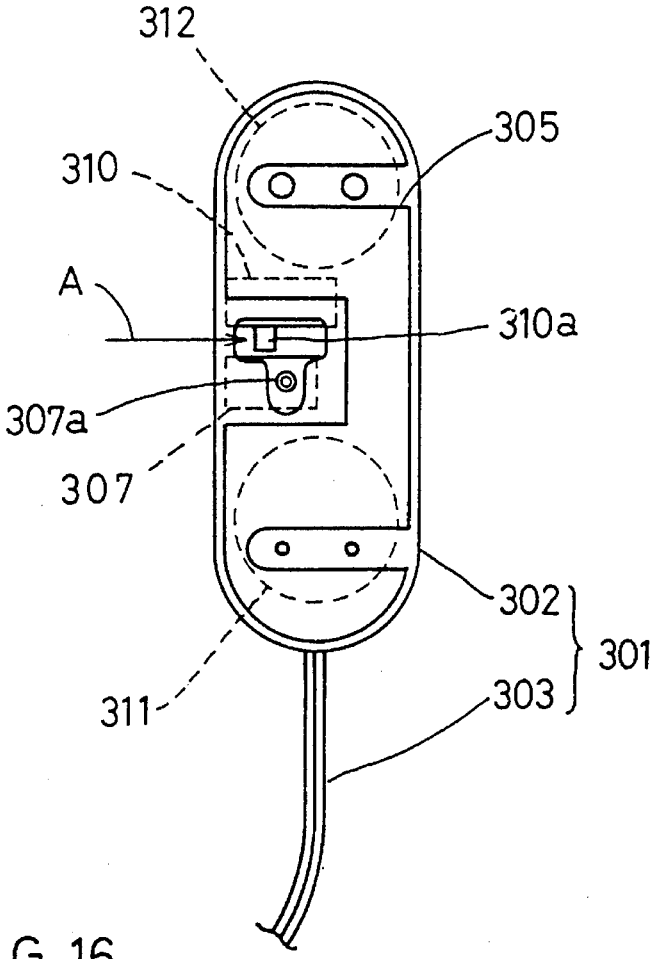
FIG. 15 is a bottom plan view of the housing of the tag device shown in FIG. 14.
Figure 16:
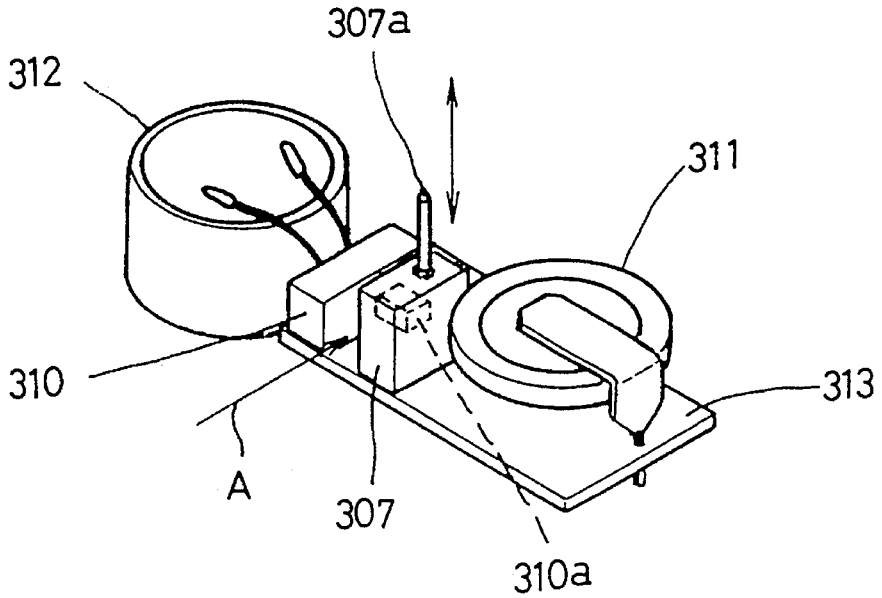
FIG. 16 is a perspective view of the parts mounted in the housing of the tag device shown in FIG. 14.

FIG. 15 is a bottom view of the case 302. FIG. 16 shows the parts in the case 302. As shown in these figures, these parts include the limit switch 307, a power switch 310, a lithium battery 311, a buzzer 312 and a circuit board 313.

The power switch 310 is turned on by inserting the rod 308 into the case 302 through the small hole 309 and pushing a lever 310*a* of the power switch 310 in the direction of arrow A. The power switch 310 is turned off by inserting the rod 308 into the case 302 through its T-shaped hole 306 and pushing the lever 310*a* of the power switch 310 in the opposite direction to its original position.

While the plunger 307*a* protrudes from the limit switch 307, the latter remains off. By pushing the plunger 307*a* into the limit switch 307*a*, it is turned on.

Figure 17:
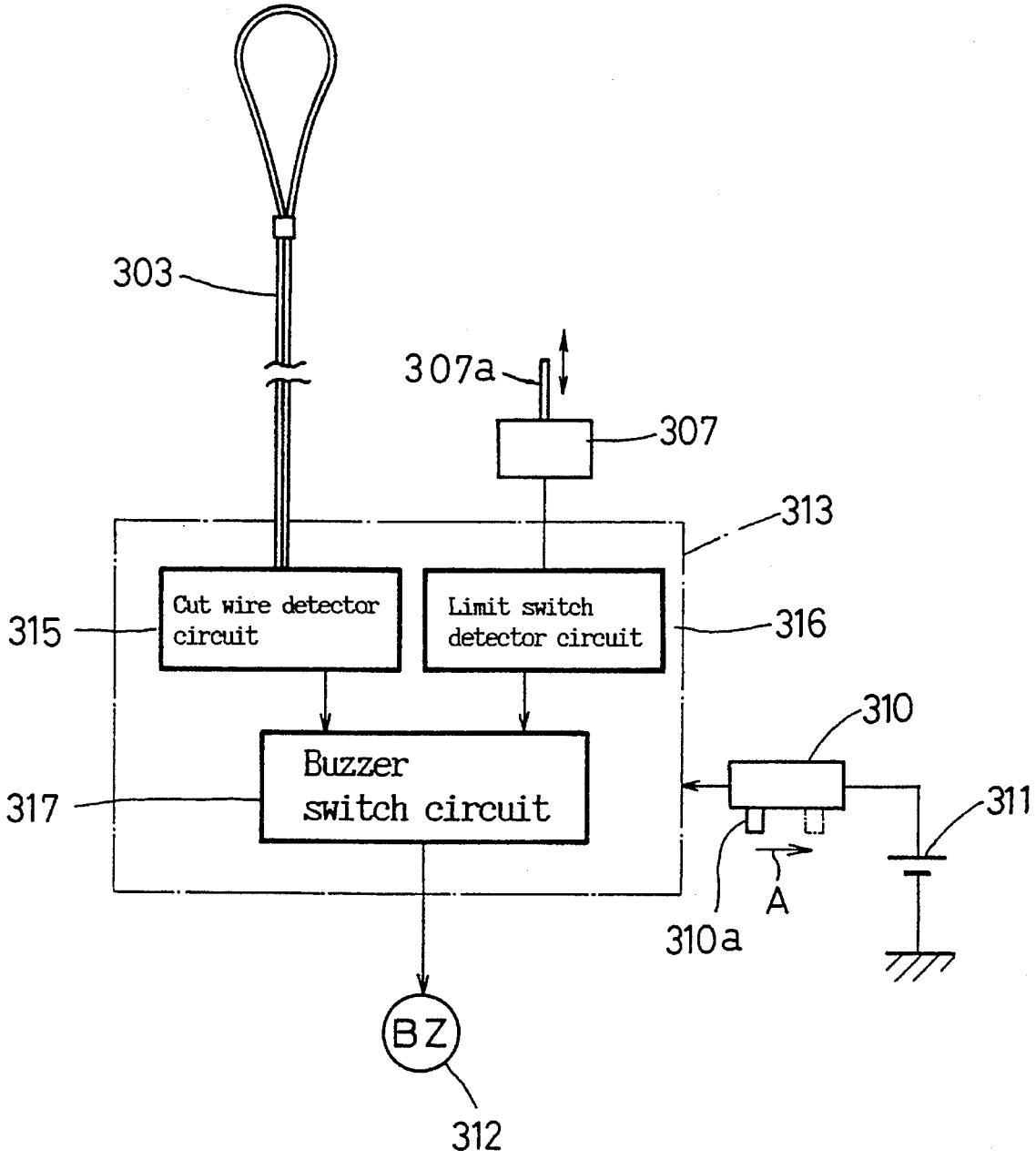
FIG. 17 is a block diagram of the tag device of FIG. 14.

FIG. 17 is a block diagram showing the structure of the tag device 301. As shown in this figure, the circuit board 313 carries a cut wire detector circuit 315, a limit switch detector circuit 316, and a buzzer switch circuit 317.

The cut wire detector circuit 315 can detect the fact that the wire has been cut. The limit switch detector circuit 316 detects the fact that the limit switch 307 has been turned off. In response to the outputs of these detector circuits 315, 316, the buzzer switch circuit 317 activates the buzzer 312.

As mentioned earlier, the power switch 310 is turned on by pushing its lever 310*a* in the direction of arrow A. As the power switch is turned on, the lithium battery 311 is connected to the circuit board 313 through the power switch 310. In this state, the circuits 315, 316 and 317 on the circuit board 313 are activated, while the buzzer 312 is ready to go off.

Figure 18:
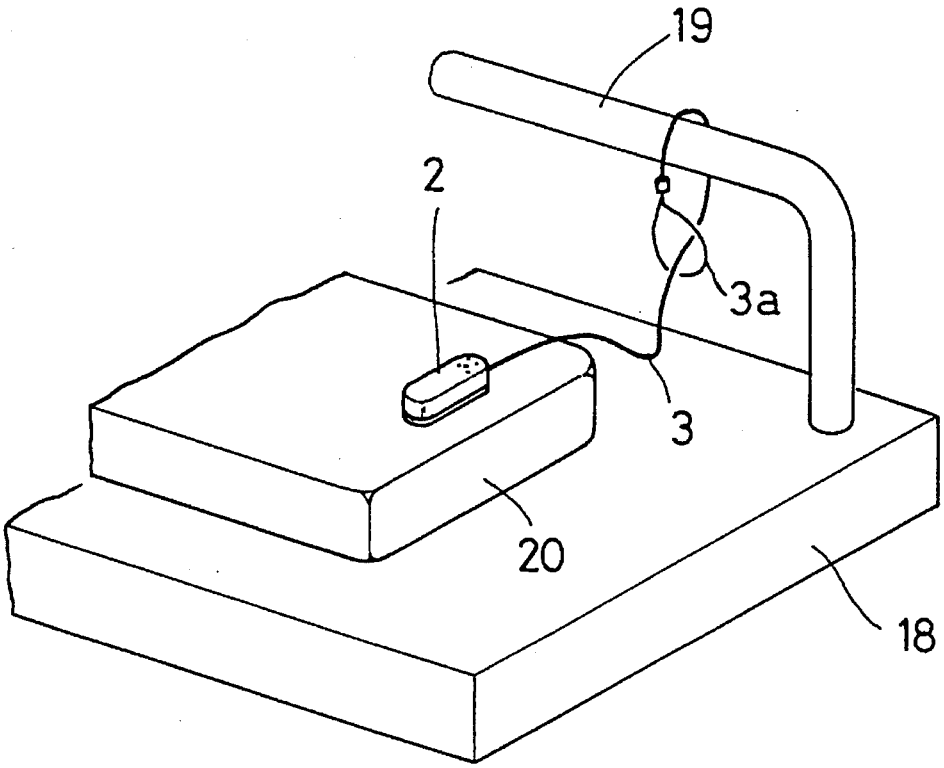
FIG. 18 is a perspective view of the tag device of FIG. 14 when in use.

As shown in FIG. 18, the case 302 is fastened to a frame 319 of a display rack 318 by putting the wire 303 around the frame and passing the case 302 through the loop 303*a* of the wire 303 so that the case cannot be removed from the rack 318.

Then, after peeling release paper (not shown) from an adhesive tape 305 stuck on the bottom of the case 302, the case 302 is pressed against merchandise 320 to bond it to the merchandise 320. In this state, the limit switch 307 is on because the plunger 307*a* of the limit switch 307 is pushed into the case 302 by the merchandise 320.

In this state, the rod 308 is inserted into the case 302 through its small hole 309 to push the lever 310*a* of the power switch 310 and turn the power switch 310 on. The tag device 301 is now operative.

Once the tag device is set in this operative position, it is impossible to move the merchandise 320 without forcibly pulling the case 302 apart from the merchandise 302 or cutting the wire 303.

If attempts are made to forcibly pull the case 302 apart from the merchandise 320, the plunger 307*a* of the limit switch 307 will protrude from case 302 through its T-shaped hole 306, thereby turning the limit switch 307 off. This fact is detected by the limit switch detector circuit 316. In response, the buzzer switch circuit 317 activates the buzzer 312.

If the wire 303 is cut, this fact is detected by the cut wire detector circuit 315. In response, the buzzer switch circuit 317 activates the buzzer 312.

In order to deactivate the tag device 301, the power switch 310 is turned off by inserting the rod 308 into the case 302 through its T-shaped hole 306 and pushing the lever 310*a* of the power switch 310 in the direction opposite to the direction of arrow A.

Since the buzzer 312 goes off if the case 302 is forcibly pulled apart from the merchandise or if the wire 303 is cut off, no one can smuggle the merchandise 320 out of the store without being noticed by store clerks. Only the buzzer 312 is activated if the limit switch 307 is turned off or the wire 303 is cut. Thus, the system is least likely to malfunction.

Besides the small hole 309 formed in one side wall of the housing, another small hole may be formed in the side wall opposite to the side wall having the hole 309. In this case, the lever 310*a* of the power switch 310 can be pushed in either direction by inserting the rod through either of these holes, so that the power switch 310 can be turned on and off while keeping the case 302 stuck on the merchandise.

Figure 19:
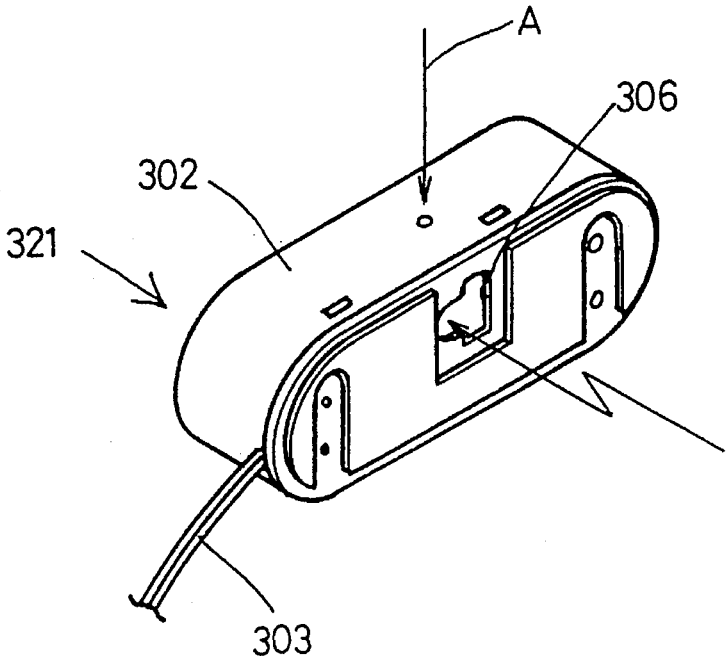
FIG. 19 is a perspective view of another embodiment of the tag device.
Figure 20:
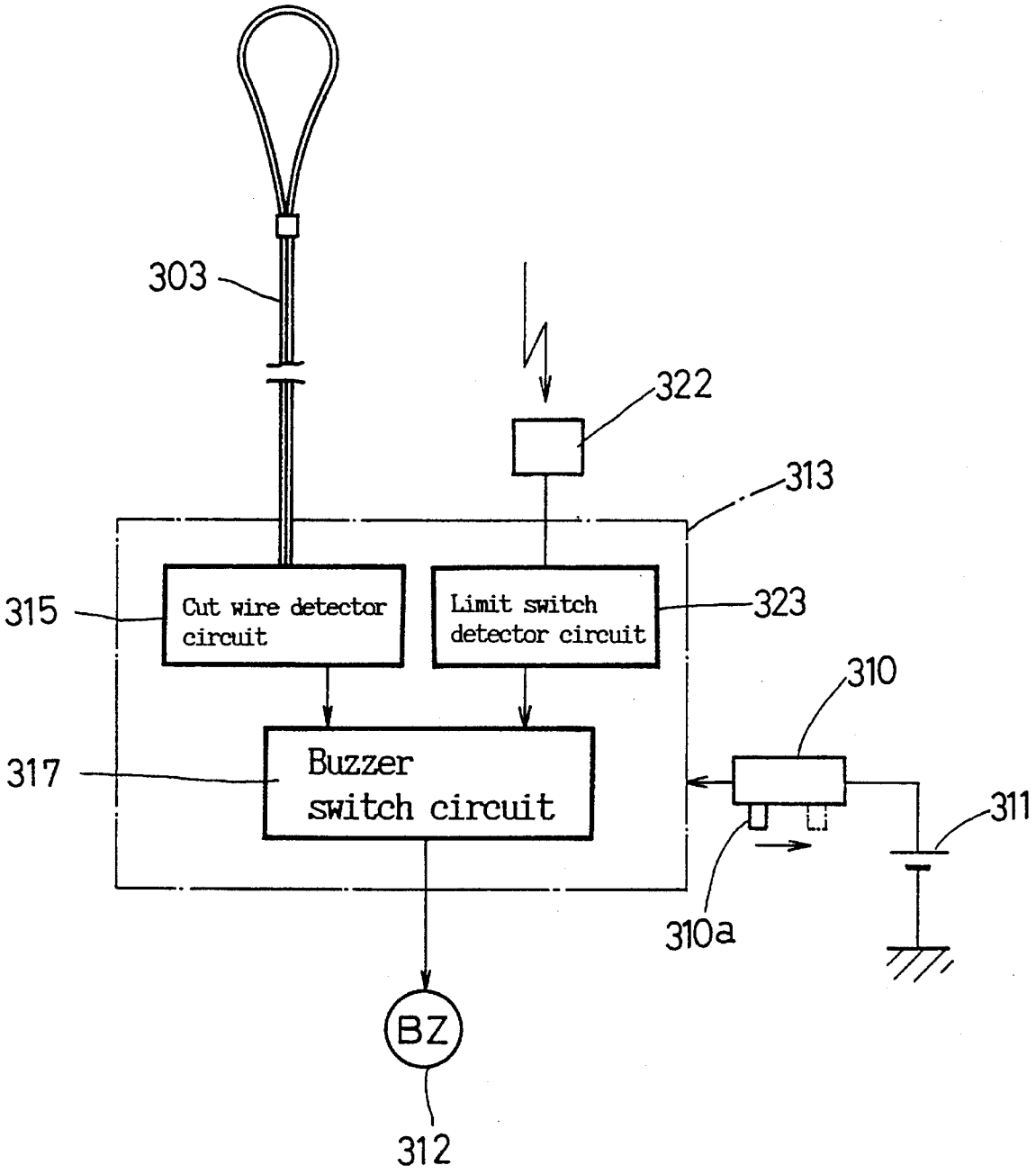
FIG. 20 is a block diagram of the tag device of FIG. 19.

FIGS. 19 and 20 show another embodiment of the anti-theft tag device of this invention. This tag device 321 has a light switch (such as a photo-diode or a photo-transistor) and a light switch detector circuit 323, instead of the limit switch 307 and the limit switch detector circuit 316 shown in FIGS. 14 through 18.

A light switch 322 is housed in the case 302. It is turned on when it receives light coming into the case through its bottom T-hole 306. The light switch detector circuit 323 detects the fact that the light switch 322 has been turned on.

In use, the wire 303 of this tag device 321 is fastened to a fixed member and the case 302 is bonded to merchandise. Then, the lever 310*a* of the power switch 310 is pushed to turn the power switch 310 on. The tag device 321 is now operative.

In this operative state, the T-hole 306 formed in the bottom of the case 302 is closed by the merchandise, so that no light comes into the case. Thus, the light switch 322 remains off.

If the case 302 is pulled apart from the merchandise in this state, light will come into the case 302 through its bottom T-hole 306, thus closing the light switch 322. This fact is detected by the light switch detector circuit 323. In response, the buzzer switch circuit 317 activates the buzzer 312.

If the wire 303 is cut off, this fact is of course detected by the cut wire detector circuit 315, so that the buzzer 312 is activated by the buzzer switch circuit 317.

In the above embodiments, we used double-coated adhesive tapes. But the case may be secured to merchandise by any other ordinary adhesive tape or by screws or bolts.

Alarming means is not limited to a buzzer but may be a light-emitting means. Also, the tag device may have means for sending electromagnetic magnetic alarm signals to an external receiver which, upon receiving such alarm signals, gives off alarms.

What is claimed is:

1. A tag device comprising:

a case;

a fastener for fastening said case to a piece of merchandise;

a limit switch having a plunger movable into and out of said case, said limit switch being in a first switch state when said plunger protrudes from said case and being in a second switch state when said plunger is pushed into said case when fastened to said piece of merchandise by coming into contact with the piece of merchandise;

a wire extending from said case for fastening said case to a fixed member;

a detecting means for detecting that said wire has been cut;

an alarm means for activating an alarm when said plunger of said limit switch protrudes from said case after having been pushed into said case by coming into contact with the piece of merchandise, and for also activating the alarm when said detecting means detects that said wire has been cut;

a small battery for powering said alarm means; and an on/off switch for turning on and off said alarm means;

wherein said limit switch, said detecting means, said alarm means, said small battery, and said on/off switch are all housed in said case.

2. A tag device as claimed in claim 1, wherein said on/off switch is a manual switch for connecting and disconnecting said small battery to and from said alarm means.

3. A tag device as claimed in claim 1, further comprising an output means provided separately from said case for producing a predetermined signal;

said on/off switch being adapted to deactivate said alarm means when said on/off switch receives said predetermined signal from said output means.

4. A tag device as claimed in claim 1, wherein said fastener is a double-coated adhesive tape stuck on a same side of said case from which said plunger protrudes.

5. A tag device comprising:

a case;

a fastener for fastening said case to a piece of merchandise;

a light switch having a light-receiving surface on one side of said case, said light switch being in a first switch state when light is incident on said light-receiving surface and being in a second switch state when said light-receiving surface is covered by the piece of merchandise after said fastening;

a wire extending from said case for fastening said case to a fixed member;

a detecting means for detecting that said wire has been cut;

an alarm means for activating an alarm when said light-receiving surface receives light after having been covered by the piece of merchandise, and for also activating the alarm when said detecting means detects that said wire has been cut;

a small battery for powering said alarm means; and an on/off switch for turning on and off said alarm means;

wherein said light switch, said detecting means, said alarm means, said small battery, and said on/off switch are all housed in said case.

6. A tag device as claimed in claim 5, wherein said on/off switch is a manual switch for connecting and disconnecting said small battery to and from said alarm means.

7. A tag device as claimed in claim 5, further comprising an output means provided separately from said case for producing a predetermined signal;

said on/off switch being adapted to deactivate said alarm means when said on/off switch receives said predetermined signal from said output means.

8. A tag device as claimed in claim 5, wherein said fastener is a double-coated adhesive tape stuck on said one side of said case having said light-receiving surface.

9. A tag device comprising:

a case, a double-coated adhesive tape stuck on one side of said case, and a wire extending from said case for fastening said case to a fixed member;

said case including therein a limit switch, a detector that detects a cutting of said wire, an alarm device coupled to said limit switch and said detector, a small battery and an alarm switch;

said limit switch having a plunger movable into and out of said case, said limit switch being in a first switch state when said plunger protrudes from said case and being in a second switch state when said plunger is pushed into said case by coming into contact with the piece of merchandise when said case is attached to the piece of merchandise by said double-coated adhesive tape;

said alarm device activating an alarm when said limit switch changes from said second switch state to said first switch state, and also activating the alarm when said detector detects that said wire has been cut;

said small battery coupled to and supplying electric power to said alarm device; and said alarm switch being manually switchable by controlling a rod extending through a small hole formed in said case so as to turn on and off said alarm device.

10. A tag device comprising:

a case, a double-coated adhesive tape stuck on one side of said case, and a wire extending from said case for fastening said case to a fixed member;

said case including therein a light switch, a detector that detects a cutting of said wire, an alarm coupled to said light switch and said detector, a small battery and an alarm switch;

said light switch having a light receiving surface on said one side of said case, said light switch being in a first switch state when light is incident on said light receiving surface and being in a second switch state when said light receiving surface is covered by the piece of merchandise when said case is attached to the piece of merchandise by said double-coated adhesive tape;

said alarm device activating an alarm when said light switch changes from said second switch state to said first switch state, and also activating the alarm when said detector detects that said wire has been cut;

said small battery coupled to and supplying electric power to said alarm device; and said alarm switch being manually switchable by controlling a rod extending through a small hole formed in said case so as to turn on and off said alarm device.

* * * * *